United States Patent [19]

Bergmann

[11] Patent Number: 4,611,475

[45] Date of Patent: Sep. 16, 1986

[54] APPARATUS FOR THE CONTROL OF THE DISPLACEMENT OF A GUIDE BAR OF A WARP KNITTING MACHINE OR THE LIKE

[75] Inventor: Gerhard Bergmann, Heusenstamm, Fed. Rep. of Germany

[73] Assignee: Karl Mayer Textilmaschinenfabrik GmbH, Obertshausen, Fed. Rep. of Germany

[21] Appl. No.: 796,874

[22] Filed: Nov. 12, 1985

[30] Foreign Application Priority Data

Nov. 17, 1984 [DE] Fed. Rep. of Germany ..... 3442090

[51] Int. Cl.[4] ..... D04B 23/00

[52] U.S. Cl. ..... 66/207

[58] Field of Search ..... 66/204, 207, 205

[56] References Cited

U.S. PATENT DOCUMENTS

| | | | |
|---|---|---|---|
| 3,664,154 | 5/1972 | Fritz | 66/207 |
| 4,335,590 | 6/1982 | Bergmann et al. | 66/207 |
| 4,414,826 | 11/1983 | Mista et al. | 66/207 |
| 4,458,508 | 7/1984 | Englert et al. | 66/207 |

*Primary Examiner*—Ronald Feldbaum
*Attorney, Agent, or Firm*—Omri M. Behr

[57] ABSTRACT

An arrangement can control displacement movement of a guide bar of a warp knitting machine or the like by means of a summation drive which, during the work cycle moves steering arrangements for underlap displacement and overlap displacement in a timely and appropriate manner. It comprises a first and a second overlap displacement control arrangement which operate in opposing directions and having a simultaneously operating underlap control arrangement, operating a switching mechanism which, upon choice, couples either the one or the other overlap control arrangement with the summing drive. If desired, there may be provided a third overlap displacement setting arrangement which is permanently coupled to the summation drive and optionally activated. In this manner, a variety of different overlap displacement patterns may be obtained with a lower switching frequency than once heretofore possible.

10 Claims, 7 Drawing Figures

APPARATUS FOR THE CONTROL OF THE DISPLACEMENT OF A GUIDE BAR OF A WARP KNITTING MACHINE OR THE LIKE

BACKGROUND OF THE INVENTION

1. Field of the Invention

The present invention relates to an apparatus for the control of the displacement arrangement of a guide bar of a warp knitting machine or the like. The invention is directed to an arrangement for the control of the displacement movement of a guide bar of a warp knitting machine or the like with the assistance of a summation which, during the working cycle, in a timely manner, displaces influenceable setting arrangements for the underlap displacement and th overlap displacement.

2. Discussion of the Relevant Art

In a known arrangement of this type (DE-OS 3,213,663 and U.S. Pat. No. 4,458,508) there is provided a summation drive operable in the longitudinal direction. The summation drive is continually in power-transferring contact over at least one biased curved surface in a plurality of elements, the elements acting through the free end of the summing arrangement upon the relevant guide bar. There exist underlap setting arrangements which influence the position of these curved surfaces for the purpose of changing the axial separation of neighboring elements. Certain of these setting arrangements each have an impulse roller which is mounted for positioning along the curved surface of an element and which is supported on the neighboring element by means of an intermediate member. For the operation of the setting arrangements there are provided eccentric cams which, being steerable by means of a switching coupling are rotatable thru 180°.

For the producing an overlap displacement, a setting curve carrier contacts the end of the summing drive distal to the guide bar. This carrier takes the form of a control disc, whose axis is rigidly located. This gives rise to a predetermined degree of overlap which cannot be adjusted during operation.

In another modification of this system the overlap displacement control arrangement is equipped with an eccentric cam, a switch and an impulse roller, in the same manner as the underlap displacement setting arrangement. With such a modification one may choose in each cycle whether one wishes to carry out an overlap or not. However, this gives rise to a rather substantial amount of switching of the setting arrangement since this switching must happen at least when sequential overlaps occur in the same direction, the latter occurring both in the underlap time period as well as the overlap time period. Since the known, appropriate, setting arrangements can only work with one speed, this has the consequence that the displacement time in the underlap is the same as the displacement time in the overlap. Thus, one must give up the more usual, longer displacement time of the underlap. The displacement of the overlap is determined by the impulse curved surfaces, that is to say, a maximum of one needle space. A different overlap displacement is therefore not possible.

Accordingly, it is an object of the present invention to provide an arrangement of the foregoing type in which, however, the setting arrangements for the underlap displacement and the setting arrangement for the overlap displacement are separated from each other but wherein, nevertheless, one may choose the manner of the overlap.

SUMMARY OF THE INVENTION

In accordance with the illustrative embodiment demonstrating features and advantages of the present invention, there is provided an arrangement for the control of the shogging movement of a guide bar of a warp knitting machine or the like. The arrangement has a plurality of steering devices coupled to the guide bar. These devices are reciprocatable to cause underlap displacement and overlap displacement of the guide bar. A summation drive can move, during the work cycle, the steering devices for initiating the underlap displacement and the overlap displacement in a timely, appropriate manner. The summation drive has an underlap displacement controller for moving the steering devices for underlap movements. Also included is a first and a second overlap displacement controller, each being operable in opposing directions and operable simultaneously with the underlap controller. The arrangement also has a switch operable to couple selectively one of either the first or second overlap controller to the summing drive.

By employing apparatus of the foregoing type, an improved arrangement is provided. In a preferred embodiment, the first and the second overlap displacement setting arrangements operate in opposing directions and through a switching arrangement which is operable substantially contemporaneously with the underlap displacement setting arrangement which by choice, couples one or the other overlap displacement control arrangement with the summation drive. Utilizing this construction, the activation of the switching arrangement in turn activates one of the two countercurrently operating overlap displacement control arrangements, to achieve its particular overlap displacement as may be appropriate for the desired pattern. In particular, by utilizing both overlap displacement control arrangements in a sequential manner, it is possible to provide successive overlaps in the same direction, that is to say, closed fringes or open Atlas bindings, without activating the overlap displacement setting arrangement during the underlap displacement time.

It is advantageous to form the setting drive of the setting arrangement as an eccentric cam which, by means of a switch coupling, is rotatable about 180°. It is then possible to construct all steerable setting drives of the arrangement in a similar manner.

With the first and second overlap displacement setting arrangement in the simplest case, it is not necessary to have steerable setting members. Particularly, it is possible to form the setting members through a continually driveable setting curve carrier with a fixed bearing. In particular, the setting curve carrier can be formed by two control discs with parallel rigidly fixed axes. Even if by such an arrangement the overlap displacement of each setting arrangement is rigidly predetermined, it is still possible, by steering of the switching arrangement, to carry out a substantial number of different overlaps.

It is further advantageous that if the setting curve carrier is formed from two control discs with parallel, rigidly implaced axes. The setting curve carriers, during the coupling step, cause the coupling elements to be forced against the setting surface and the appropriate coupling surface.

BRIEF DESCRIPTION OF THE DRAWING

The above brief description as well as other features and advantages of the present invention will be more fully appreciated by reference to the following detailed description of a presently preferred but nonetheless illustrative embodiment in accordance with the present invention when taken in conjunction with the accompanying drawings, wherein.

DESCRIPTION OF THE PREFERRED EMBODIMENTS

Figure 1:
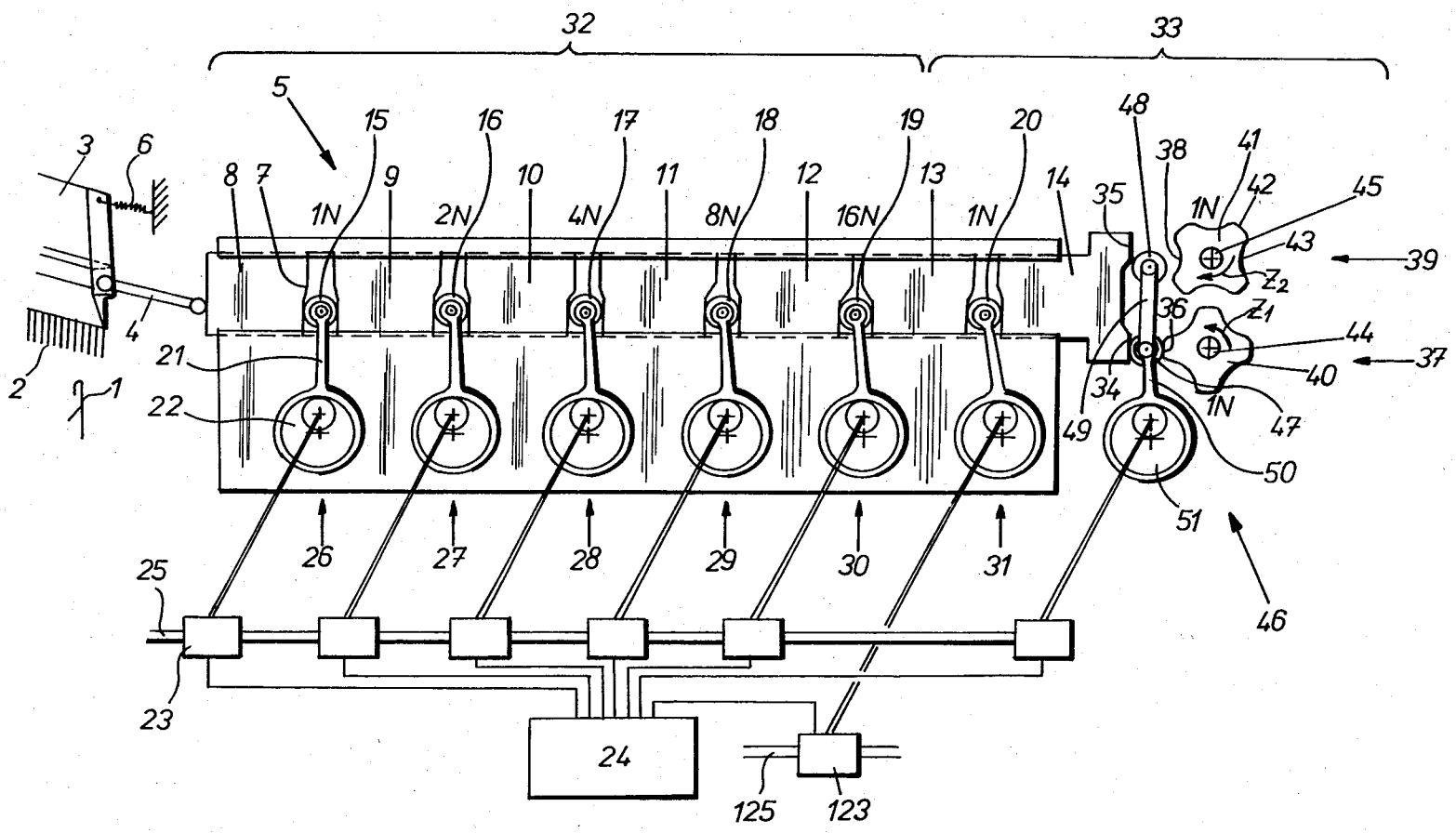
FIG. 1 is a schematic side view of an embodiment of the present invention.

FIG. 1 shows needles 1 to which the thread is fed from conventional guides 2 on a guide bar 3. Bar 3 is supported to be reciprocated axially in the usual fashion, by means of driving rod 4, displaceable by means of summation drive 5. The guide bar 3 is biased by tension spring 6.

The summation drive 5 comprises inside curved displacement surfaces 7 on elements 8 thru 14 which are longitudinally slideable in a fixed guide-way. Surfaces 7 are oriented to provide inwardly converging spaces between which are a plurality of impulse elements in the form of impulse rollers 15 thru 20. Each impulse roller is connected by its axis via connecting rod 21 with eccentric cam 22. Cams 22 when rotated 180° cause rollers 15–20 to swing from one extreme position to the other. Cams 22 by means of couplers 23 is activatable by computer 24, as described in U.S. Pat. No. 4,458,508. Cams 22 can be driven through 180° by means of a continuously rotating drive shaft 25, commonly coupled to each of the couplers 23. The setting member 15, 21 and 22 together with the switch coupling 23 each form a setting arrangement so that setting arrangements 26 thru 31 are provided.

The segment 32 of summation drive 5 is responsible for the underlap displacement. The underlap displacement arrangements 26 thru 30 serve to provide underlap displacements of 1N, 2N, 4N, 8N as well as 16N, wherein N equals one needle space so that an underlap displacement of 1 to 33 needle spaces is possible.

Segment 33 of the arrangement is responsible for the overlap displacement. Final element 14 is a block having a forked outer end, useful in effectuating an overlap displacement. To serve this purpose two coupling surfaces 34 and 35 are provided to the outer end of final element 14. Said surfaces 34 and 35 are perpendicular to the travel direction of summation drive 5.

Coupling surface 34 is positioned opposite setting surface 36 of overlap displacement setting arrangement 37. Coupling surface 35 is positioned opposite setting surface 38 of overlap displacement setting arrangement 39. The setting arrangements each comprise setting curve carriers 40 and 41, respectively, in the form of control discs each with protrusions 42 and valleys 43. The control discs are continually rotatable upon fixed axes 44 and 45, respectively.

It is particularly advantageous to provide that final element 14 of the summation drive 5 is provided distal from the guide bar 3 and is provided with two coupling surfaces 34, 35 perpendicular to the displacement direction. Each of the surfaces 34, 35 provide a setting member with a setting surface for the first and the second overlap displacement setting arrangements 37, 39. These setting surfaces 36, 38 are each positioned opposite a coupling surface 34, 35 and may be set in two different positions relative to the overlap displacement. The switching arrangement 46 has two coupling elements 47, 48 which are positionable alternatively between one setting surface 36 and the appropriate coupling surface 34 or the other setting surface 38 and the coupling surface appropriate thereto, surface 35.

It is particularly preferred to use impulse rollers 47, 48 as coupling elements whose axes are connected with each other on frame 49 and with a setting drive 50, 51 of the switching arrangement which positions the impulse rollers 47, 48 perpendicular to the displacement direction of the summation drive 5. These impulse rollers 47, 48 which, in the known manner (e.g. the arrangement of FIG. 2), may be formed from multiple rollers that are readily pushed betwen the setting surfaces 36, 38 and the coupling surfaces 34, 35.

This gives rise to a very simple construction in which the switching arrangement 46 for the coupling elements merely has to move to and fro. It is preferred that the switching arrangement 46 has its two coupling elements 47 and 48 in the form of impulse rollers which have a lesser distance from each other than the distance between coupling surfaces 34 and 35. This spacing being maintained by connecting their axes to each other upon frame 49.

Frame 49 is connected with a setting member in the form of an eccentric cam 51 through the agency of rod 50 which, by operation of the appropriate switch coupling 23 can rotate 180° whereby coupling element 47 can be loosened from the illustrated contact position between coupling surface 34 and setting surface 36 and in place thereof coupling element 48 is placed in contact position between coupling surface 35 and setting surface 38.

Figure 2:
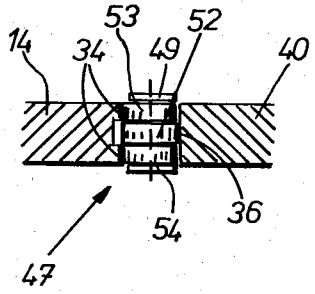
FIG. 2 is a plan view of a coupling element of the embodiment of FIG. 1.

The coupling element 47 is an impulse roller having a plurality of single rollers set on a single axis, for example, roller 52 (as shown in FIG. 2) which contacts setting surface 36 and the two rollers 53 and 54 which contact coupling 34. See also the related disclosure in U.S. Pat. No. 4,458,508, FIG. 3.

The turning direction is indicated by arrows Z1 and Z2 on control discs 40 and 41, respectively.

It is particularly advantageous to have a third overlap displacement setting arrangement 31 which is continuously coupled with the summation drive 5 and is steerable by choice. It is particularly preferred that the overlap displacement of the third overlap displacement setting arrangement 31 be equal to that of the first 37 and second 39 overlap displacement setting arrangements. Utilizing this third setting arrangement 46 the overlap displacement can be so increased that, for example, one may be provided with a two-needle space overlap, that is to say, a Koeper binding, or it is possible to compensate the overlap displacement of the first 37 or second 39 setting arrangement so that no overlap occurs.

In a similar construction of the underlap setting arrangement (and at least one overlap displacement arrangement) the drive for the underlap setting arrangement should run slower than the drive for the overlap setting arrangement 31. This can be achieved for example, by use of similar switch couplings 23, in that the switch coupling 23 for the underlap displacement 32 and the overlap displacement 31 setting arrangements have drive shafts 25, 125 with different rates of rotation.

Figure 3:
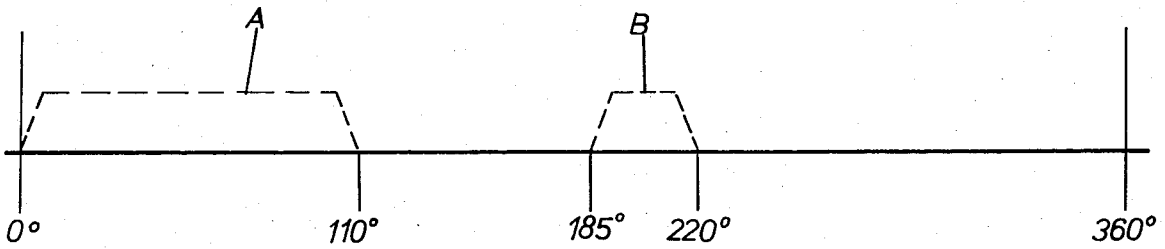
FIG. 3 is a graphical representation of the working cycle.

In FIG. 3 the working cycle from 0° to 360° is shown. While interval A runs, for example, from 0° to 110°, the underlap occurs. This means that the shaft 25 for the underlap displacement setting arrangements 26 thru 30 and for the switching arrangements 46, should have such a rate of rotation that the 180° rotation of the single eccentric setting member should be completed after a rotation of 110°. The interval B between, for example, 185° and 220° sets the time frame for the overlap displacement. The time frame B is substantially shorter than the time frame A. For this reason, control discs 40 and 41 have such rising and falling surfaces and such a rate of rotation that each overlap is completed within time frame B. Also, the third overlap setting arrangement 31 is more rapidly activated than the underlap setting arrangements 26 thru 30. For this reason, the appropriate switch coupling 123 is connected to a drive shaft 125 which has a higher rate of rotation than shaft 25. The switching couplings 23 and 123, respectively, have the type of construction which is known from DE-OS 2,741,200 which disclosure is incorporated herein by reference.

The switching arrangement 26–30 must be activated substantially contemporaneously with the underlap displacement control arrangement. Since this displacement occurs during the underlap it can, without difficulty, be calculated into the size of the underlap displacement. Consequently, the underlap displacement time and the overlap displacement can be set to be different. Thus, displacement times can be utilized in a better manner and in particular, a longer underlap displacement time may be chosen. Insofar as the arrangements carry out switchings, there is no more than one switching per work cycle. This gives rise to a smaller number of switching steps and hence, lowers the friction and the noise. When the overlap displacement setting arrangement utilizes a displacement of one needle space, there occurs, by activation of the switching arrangement, a similar displacement of one needle space.

Figure 4:
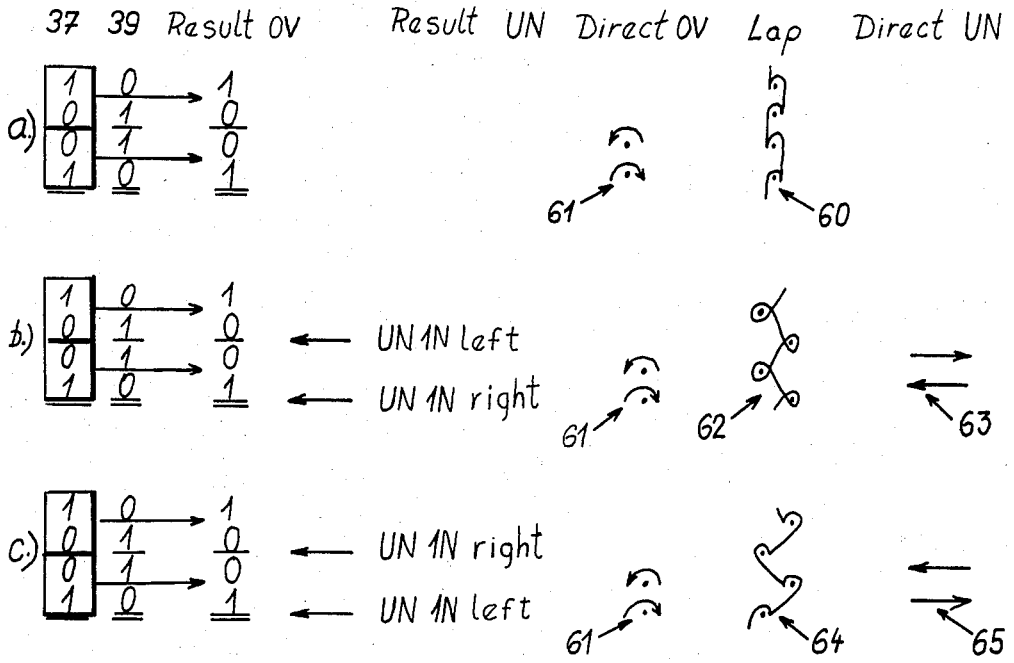
FIGS. 4 through 7 are graphical representations of different modes of utilizating the overlap setting arrangement of FIG. 1.
Figure 5:
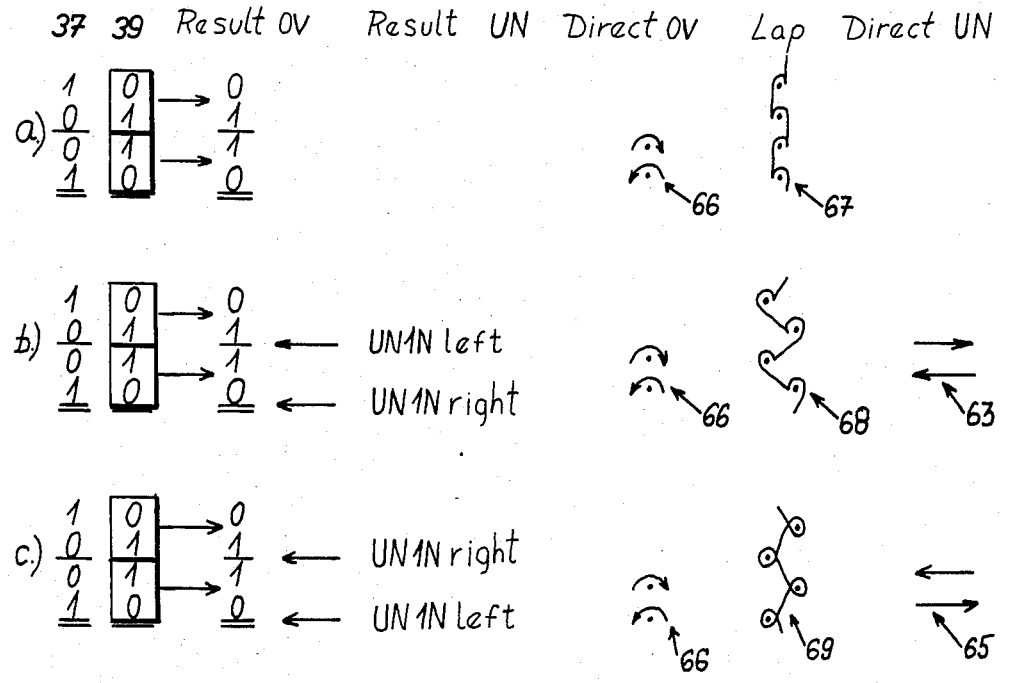
Figure 6:
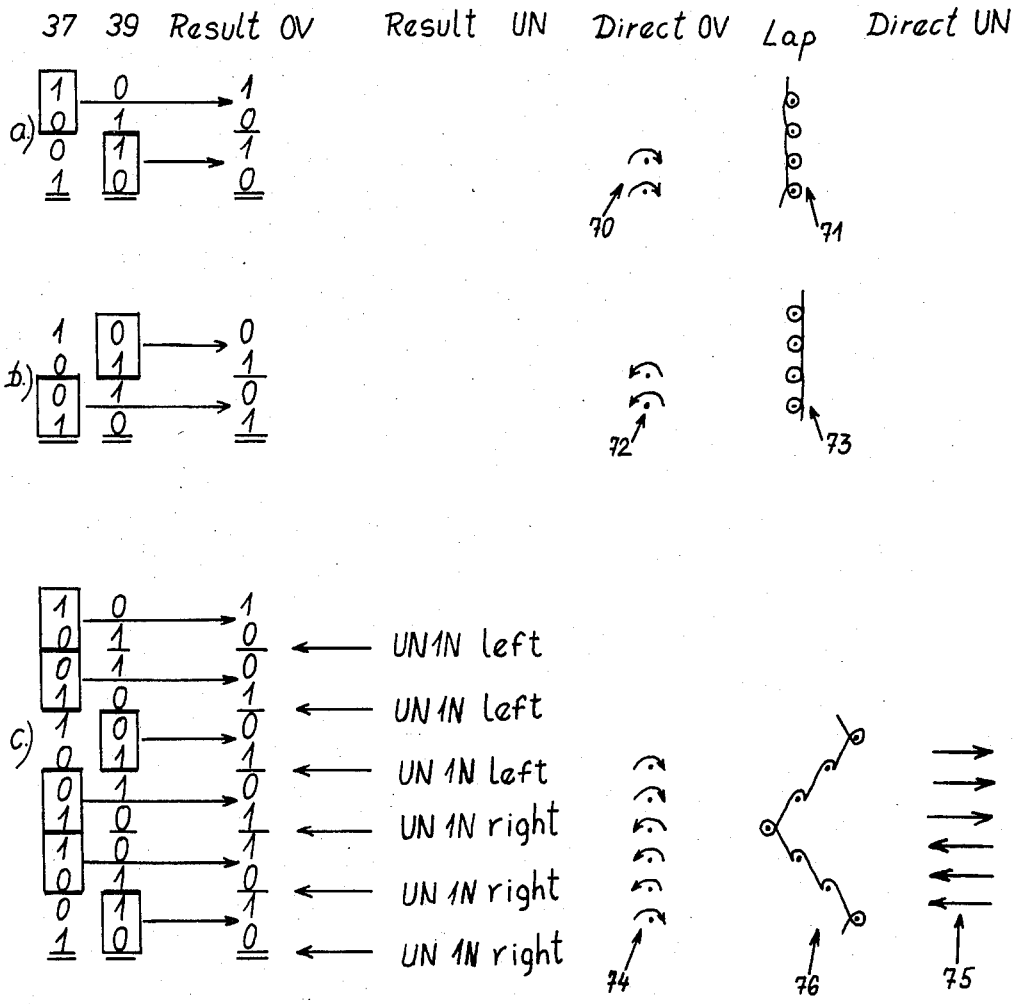

In FIGS. 4 thru 6 there are shown side-by-side the position of the setting surfaces of the overlap displacement setting arrangements 37 and 39 with the transfer of 1 thru 0 or 0 thru 1 (corresponding to two machine cycles). The setting arrangement selected by switching arrangement 46 is shown framed in a box. The column next to it (Result OV) is thus the resulting overlap displacement. Next to it in the following column is Result UN, that is to say, the corresponding underlap displacement. The following column to the right thereof (Direct. OV), signifies the direction of the overlap displacement. The Lap column shows the usual lapping diagram but over four machine cycles. The path of the warp thread in column Direct. UN shows the direction of the corresponding underlap displacement.

FIG. 4 only shows the effect of the first overlap displacement arrangement 37. In FIG. 4*a* there is produced an open fringe 60 in which the overlap 61 commences by running from left to right. In this example no underlapping is produced by components 32 which remain quiescent.

In FIG. 4*b* there follows, after the first overlap (to the right), un underlap (UN) over one needle space (1N) to the left and after the second overlap (to the left), an underlap over one needle space to the right. This leads to the lapping 62, that is to say, a closed tricot wherein the overlap 61 is retained and the underlap 63 is added thereto.

In FIG. 4*c* the underlap displacement begins with a movement to the left. This produces a lapping 64 in the form of an open tricot in which the overlap 61 remains the same but the underlap 65 is changed.

In FIG. 5 only the second overlap setting arrangement 39 is operative. In FIG. 5*a* the displacement direction of overlap 66 is opposite to that shown in FIG. 4*a*. There is thus obtained an open fringe 67 which however commences with an overlap to the left.

In FIG. 5*b* there is obtained an open tricot 68 and in FIG. 5*c* a closed tricot 69, which are mirror images of FIGS. 4*c* and 4*b*.

In FIG. 6 both overlapping displacement setting arrangements 37 and 39 are activated. In FIG. 6*a* the overlap always goes in the same direction 70 so that the closed fringe 71 is obtained. It will be noticed that the arrangements 37 and 39 alternate to accomplish overlapping in the same direction.

In FIG. 6*b* the overlap always goes in the other direction 72 so that the closed fringe 73 runs in the opposite direction.

In FIG. 6*c* the different overlap directions 74 are combined with those of the underlap designated 75 to provide the lapping shown as 76.

Figure 7:
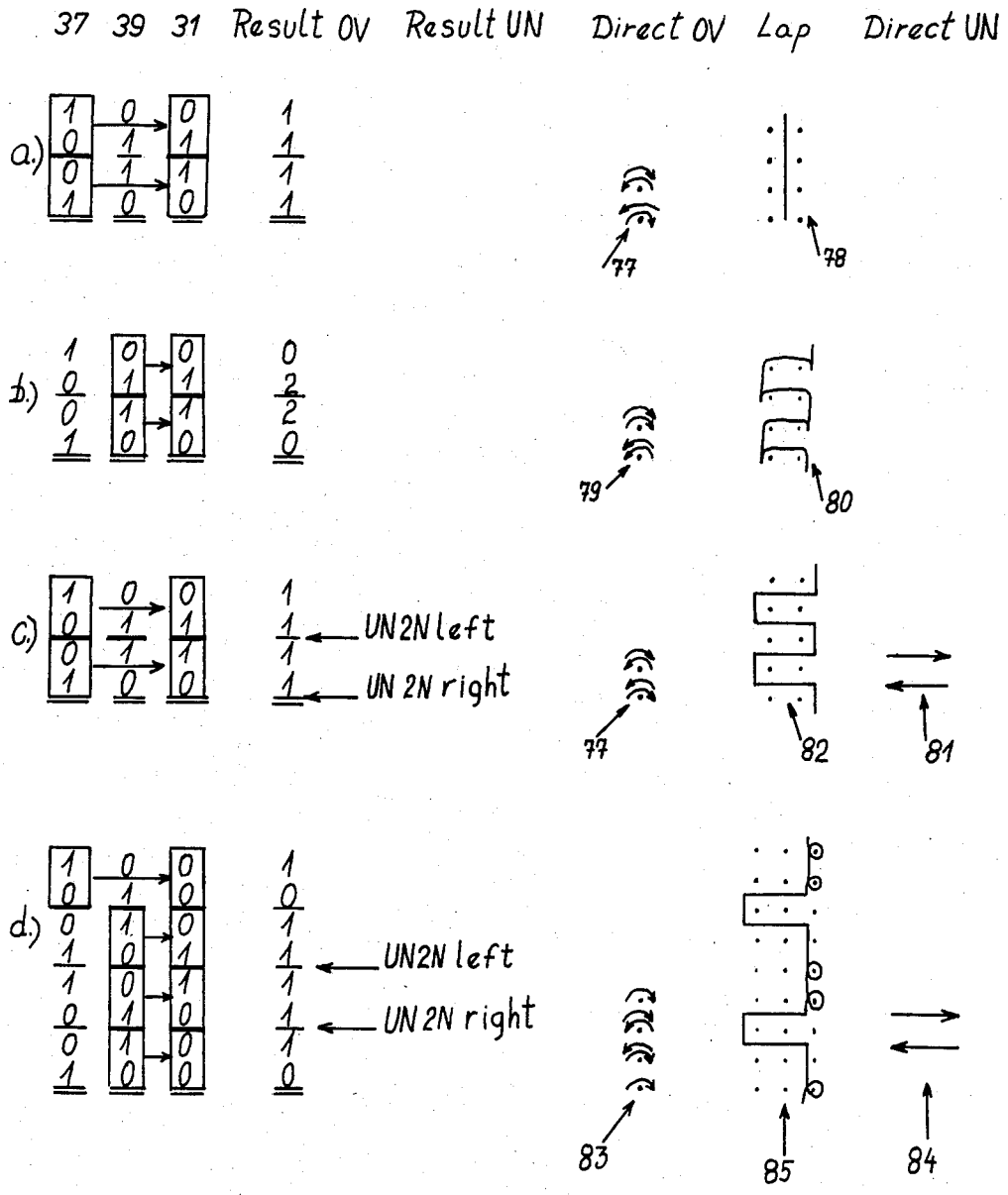

In FIG. 7 the third overlap displacement setting arrangement 31 is activated. In FIG. 7*a* this third setting arrangement 31 compensates for the action of the first setting arrangement 37 so that the guide bar is always in position 1 and the overlap 77 is compensated for. Thus, there is produced the straight inlay thread 78.

In FIG. 7*b* on the other hand, the actions of the second and third overlap displacement setting arrangements are additive as shown in overlap 79 so that the lap 80 which is produced is a overlap over two needle spaces.

In FIG. 7*c* there is additionally provided to the overlap of FIG. 7*a* an underlap 81 over two needle spaces. This leads to lapping 82.

In FIG. 7*d* the arrangements of FIGS. 6*a*, 7*a* and 7*c* are combined with each other so that from overlap 83 and underlap 84, lap 85 is produced.

It is clear that several patterning systems are possible, which may be produced simply by operation of the switch coupling 23 and 123 thru the control arrangement 24.

Obviously, many modifications and variations of the present invention are possible in light of the above teachings. It is, therefore, to be understood that within the scope of the appended claims, the invention may be practiced otherwise than as specifically described.

What is claimed is:

1. An arrangement for the control of the shogging movement of a guide bar of a warp knitting machine or the like, comprising:

a plurality of steering devices coupled to said guide bar, said devices being reciprocatable to cause underlap displacement and overlap displacement of said guide bar;

summation drive means for moving, during the work cycle, said steering devices for initiating the underlap displacement and the overlap displacement in a timely, appropriate manner, said summation drive means having underlap displacement control means for moving said steering devices for underlap movements;

a first and a second overlap displacement control means, each being operable in opposing directions and operable simultaneously with said underlap control means; and switching means operable to couple selectively one of either the first or second overlap control displacement means to said summing drive.

2. An arrangement in accordance with claim 1 further comprising:

third overlap displacement control means constantly coupled with said summing drive and being selectively operable.

3. An arrangement in accordance with claim 2 wherein said third overlap displacement control means is sized to produce an overlap displacement of the same magnitude as is producible by said first and said second overlap displacement control means.

4. An arrangement in accordance with claim 1 wherein said underlap displacement control means and at least one of said overlap displacement control means each have a drive means having equivalent structure, the drive means for said at least one of said underlap displacement control means runs slower than the drive means for the overlap displacement control means.

5. An arrangement in accordance with claim 1 further comprising:

an element mounted at that end of said summation drive distal to said guide bar, said element having two coupling surfaces oriented perpendicularly to the direction of reciprocation of said steering devices, said first and said second overlap displacement control means each having a setting surface, each setting surface being alternately positionable opposite a corresponding one of said coupling surfaces, said switching means comprising:

two coupling elements each corresponding to a different one of said setting surfaces, each of said coupling elements being alternately positionable between its corresponding one of said setting surfaces and the coupling surface corresponding thereto.

6. An arrangement in accordance with claim 5 wherein said coupling elements comprise:

impulse rollers having spaced axes that are mutually connected with each other, said switching means including:

a setting drive for displacing the impulse rollers perpendicularly to the displacement direction caused by the summation drive.

7. An arrangement in accordance with claim 6 wherein said setting drive of the switching means comprises:

an eccentric cam which is rotatable thru 180°; and a switch coupling coupled to said cam for selectively rotating it through 180°.

8. An arrangement in accordance with claim 7 wherein said setting surfaces of the first and the second overlap displacement control means each comprise:

a continually drivable, setting-curve carrier for rotating about a fixed axis.

9. An arrangement in accordance with claim 8 wherein said setting-curve carriers comprise:

two control discs rotatably mounted about two parallel fixed axes.

10. An arrangement in accordance with claim 9 wherein the setting curve carriers are rotatable in opposing directions synchronously with said coupling elements of said switching means.

* * * * *